US010927565B2

(12) United States Patent
Goldstein

(10) Patent No.: US 10,927,565 B2
(45) **Date of Patent: *Feb. 23, 2021**

(54) BRIDGE ADAPTER

(71) Applicant: Steven M. Goldstein, Herald, CA (US)

(72) Inventor: Steven M. Goldstein, Herald, CA (US)

( * ) Notice: Subject to any disclaimer, the term of this patent is extended or adjusted under 35 U.S.C. 154(b) by 222 days.

This patent is subject to a terminal disclaimer.

(21) Appl. No.: 16/016,618

(22) Filed: Jun. 24, 2018

(65) Prior Publication Data

US 2018/0371793 A1 Dec. 27, 2018

Related U.S. Application Data

(63) Continuation-in-part of application No. 15/401,104, filed on Jan. 9, 2017, now Pat. No. 10,767,389.

(51) Int. Cl.

| | |
|---|---|
| ***E05B 17/06*** | (2006.01) |
| ***E05B 63/08*** | (2006.01) |
| ***E05B 9/08*** | (2006.01) |

(52) U.S. Cl.

CPC ..... *E05B 17/06* (2013.01); *E05B 9/08* (2013.01); *E05B 63/08* (2013.01)

(58) Field of Classification Search

CPC ..... E05B 17/06; E05B 9/08; E05B 63/08

See application file for complete search history.

(56) References Cited

U.S. PATENT DOCUMENTS 7,909,168 B2 * 3/2011 Virvo ..... B65D 5/5213 206/745

* cited by examiner

*Primary Examiner* — Kristina R Fulton
*Assistant Examiner* — Thomas L Neubauer
(74) *Attorney, Agent, or Firm* — Kali Law Group, P.C.

(57) ABSTRACT

Bridge adapters configured for insertion into a door stile cavity within a door stile are presented, the bridge adapter including: a planar body including, a first plate disposed along a proximal end of the planar body, where the first plate includes a first plate front edge disposed along the proximal end and a first plate back edge located along opposite ends of the first plate, where the first plate front edge includes a locking tab sized to couple with a locking indent, a second plate including a second plate front edge and a second plate back edge located along opposite ends of the second plate, where the second plate front edge is mechanically coupled along the first plate back edge by a leading hinge.

16 Claims, 9 Drawing Sheets

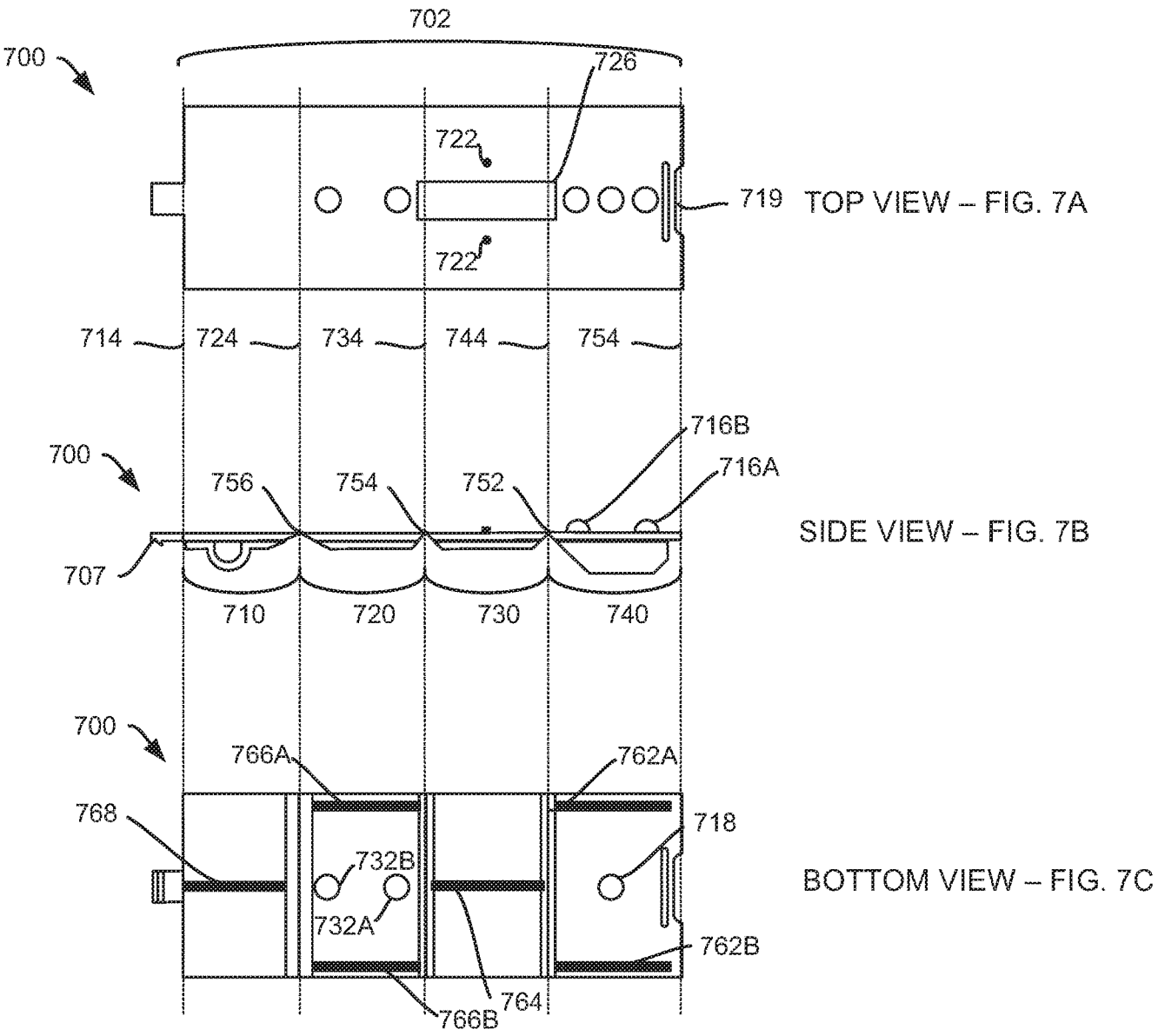
TOP VIEW – FIG. 7A
SIDE VIEW – FIG. 7B
BOTTOM VIEW – FIG. 7C
700
702
714
724
734
744
754
719
722
722
726
700
707
716A
716B
752
754
756
710
720
730
740
700
768
766A
762A
718
762B
764
766B
732A
732B

BRIDGE ADAPTER

FIELD OF INVENTION

The present invention relates generally to lock accessories, and more specifically to adapters for supporting mortise locks.

BACKGROUND

Mortise locks are widely used for commercial and residential applications. A mortise lock, unlike a cylinder lock, is installed in a cavity cut or defined within the door stile (a cylinder lock is installed in a hole cut through the door). After installation, the mortise lock body is contained completely in the cavity. Since the body size of a mortise lock is not standardized, the pre-cut or previously used cavity may not be properly sized to match a particular mortise lock. This is particularly true when locks are modernized or updated thus complicating lock installation.

In addition, in some installations, a user may desire to eliminate the mortise lock altogether and replace the mortise lock with a faceplate. In general, a faceplate must present a smooth surface along the door stile. Unfortunately, doors that previously included a mortise lock may lack a surface to which to attach the faceplate. In those instances, expensive replacement doors may be necessary.

As such bridge adapters are presented herein.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented below.

As such, bridge adapters configured for insertion into a door stile cavity within a door stile are presented, the bridge adapter including: a planar body including, a first plate disposed along a proximal end of the planar body, where the first plate includes a first plate front edge disposed along the proximal end and a first plate back edge located along opposite ends of the first plate, where the first plate front edge includes a locking tab sized to couple with a locking indent, a second plate including a second plate front edge and a second plate back edge located along opposite ends of the second plate, where the second plate front edge is mechanically coupled along the first plate back edge by a leading hinge, where the second plate includes at least one through hole sized to receive the at least one raised feature, a third plate including a third plate front edge and a third plate back edge located along opposite ends of the third plate, where the third plate is mechanically coupled along the third plate front edge and the second plate back edge by a middle hinge, and a fourth plate including a fourth plate front edge and a fourth plate back edge located along opposite ends of the fourth plate, where the fourth plate front edge is mechanically coupled along the third plate back edge by a trailing hinge. In some embodiments, the planar body is manufactured from a polymeric material and where the leading hinge, the middle hinge, and the trailing hinge are living hinges. In some embodiments, bridge adapters further include: at least one of the first plate, the second plate, the third plate, and the fourth plate includes at least one support rib disposed along an inner surface of the plate. In some embodiments, bridge adapters further include: all of the plates include at least one support rib disposed along an inner surface of each plate. In some embodiments, the middle hinge and trailing hinge have a range of motion of more than approximately 90-degrees and where the leading hinge has a range of motion of at least approximately 120 degrees. In some embodiments, bridge adapters further include: the leading hinge has a range of motion of at least approximately 130 degrees. In some embodiments, the second plate is substantially the same width as the door stile cavity, where the third side plate includes a friction-enhancing feature for engaging a wall of the door stile cavity, and where the friction enhancing feature is raised and disposed along an outer surface of the third plate.

In other embodiments, methods of installing bridge adapters in a door stile cavity are presented including: providing a first bridge adapter, where the first bridge adapter includes: a planar body including, a first plate disposed along a proximal end of the planar body, where the first plate includes a first plate front edge disposed along the proximal end and a first plate back edge located along opposite ends of the first plate, where the first plate front edge includes a locking tab sized to couple with a locking indent, a second plate including a second plate front edge and a second plate back edge located along opposite ends of the second plate, where the second plate front edge is mechanically coupled along the first plate back edge by a leading hinge, where the second plate includes at least one through hole sized to receive the at least one raised feature, a third plate including a third plate front edge and a third plate back edge located along opposite ends of the third plate, where the third plate is mechanically coupled along the third plate front edge and the second plate back edge by a middle hinge, and a fourth plate including a fourth plate front edge and a fourth plate back edge located along opposite ends of the fourth plate, where the fourth plate front edge is mechanically coupled along the third plate back edge by a trailing hinge, inserting the first bridge adapter into the door stile cavity through the opening by folding the leading hinge at least more than 90 degrees; folding the leading hinge and the middle hinge of the first bridge adapter in such a way that the first plate is in contact with a first wall of the door stile cavity, the second plate is in contact with a back wall of the door stile cavity, and the third plate is in contact with a second wall of the door stile cavity; and folding the tailing hinge of the first bridge adapter such that the locking indent engages with the locking tab. In some embodiments, methods further include: providing a second bridge adapter; inserting a second bridge adapter into the door stile cavity; inserting the second bridge adapter into the door stile cavity through the opening; folding a leading hinge and a middle hinge of the second bridge adapter in such a way that a first plate of the second bridge adapter is in contact with the first wall of the door stile cavity, a second plate of the second bridge adapter is in contact with the back wall of the door stile cavity, and a third plate of the second bridge adapter is in contact with the second wall of the door stile cavity; engaging the at least one raised feature of the first bridge adapter with the at least one through hole of the second bridge adapter; and folding a trailing hinge of the second bridge adapter such that a locking indent of the second bridge adapter engages with a locking tab of the second bridge adapter.

BRIEF DESCRIPTION OF THE DRAWINGS

The present invention is illustrated by way of example, and not by way of limitation, in the figures of the accompanying drawings and in which like reference numerals refer to similar elements and in which:

FIGS. 7A-7C are illustrative representations of various views of a bridge adapter in accordance with embodiments of the present invention;

DETAILED DESCRIPTION

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

For purposes of the present disclosure, a "bridge adapter" is a spacer that can support a snap-in bridge that, in turn, may support a mortise lock or a faceplate. A "cavity" is a hollow space within a door stile. An "opening" is the opening to the cavity located on the surface of the door stile.

An object of the present invention is to provide a bridge adapter that can support a bridge which supports the body of a mortise lock or faceplate in a cavity that is too deep for the body of the mortise lock.

Another object of the present invention is to provide a bridge adapter that can be inserted into a cavity within the door stile, even when the opening of the cavity is smaller than the cavity itself.

One embodiment of the bridge adapter of the present invention is a body that, when folded, becomes a rectangular tube-shaped spacer that is strong enough to support the body of a mortise lock or faceplate. In embodiments, a tail coupled with the body may be used for insertion of the body into a door stile cavity. The body folds into the desired rectangular tube shape as it is pushed into the cavity.

Figure 1:
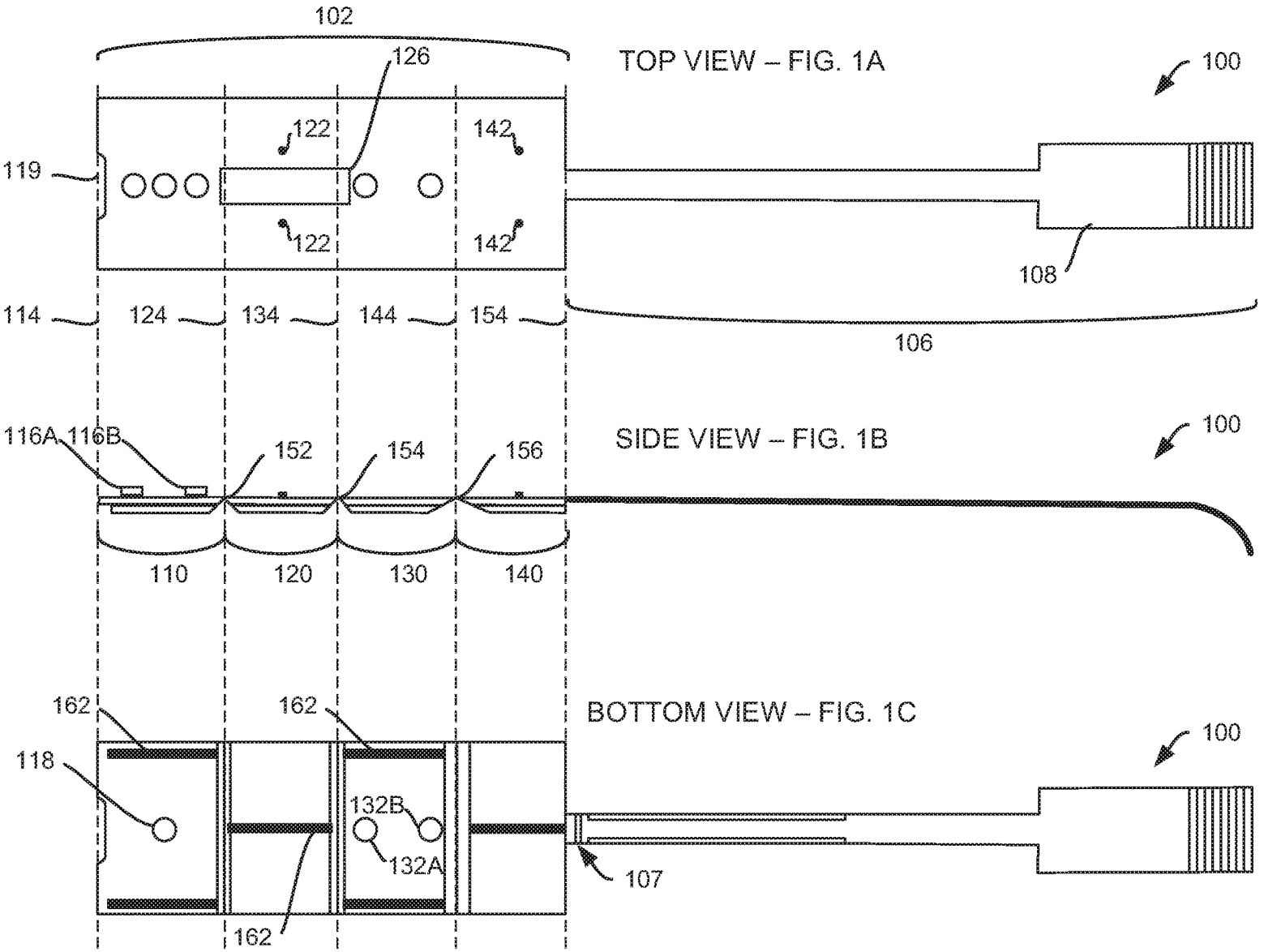
FIGS. 1A-1C are illustrative representations of various views of a bridge adapter in accordance with embodiments of the present invention.

FIG. 1 is an illustrative representation of various views of a bridge adapter in accordance with embodiments of the present invention. In particular, as illustrated in FIGS. 1A to 1C, bridge adapter 100 may include planar body 102 which may further include a number of features. For example, planar body 102 may include top plate 110, that is disposed along distal edge of planar body 102. Top plate 110 may be defined by top plate front edge as indicated by dashed line 114 disposed along a distal end and top plate back edge as indicated by dashed line 124 disposed opposite top plate front edge. The illustrated dashed lines are for clarity in defining the various plates presented across all views. Further illustrated are raised features 116A and 116B. Raised features 116A and 116B may be useful in stacking bridge adapter embodiments as will be discussed in further detail below for FIG. 4. In addition, top plate 110 may include a through hole 118, which may be smooth bore or threaded and centered with the top plate in embodiments. Still further illustrated is locking indent 119 sized to couple with raised locking feature 107.

Planar body 102 may additionally include first side plate 120, located proximally to top plate 110. First side plate 120 may be defined by the first side plate front edge as indicated by dashed line 124 disposed along a distal end and the first side plate back edge as indicated by 134 disposed opposite the first side plate front edge. The first side plate front edge may be connected with the top plate back edge by first hinge 152. In embodiments, first hinge 152 may have a range of motion of more than approximately 90-degrees. In one embodiment, a range of motion of the first hinge is approximately 93 degrees. First hinge 152 is preferably strong and capable of flexing without damage. In one embodiment, the first hinge is a living hinge. As known in the art, a living hinge is a thin flexible hinge (flexure bearing) made from the same material as the two rigid pieces it connects, rather than cloth, leather, or some other flexible substance. A living hinge is typically thinned, cut, or formed to allow the rigid pieces to bend along the line of the hinge. First side plate 120 may also include friction-enhancing features 122 which may assist in retaining the bridge adapter in the cavity by engaging with the walls of the cavity. In an embodiment, as illustrated in FIG. 1A, friction-enhancing feature 122 includes two raised bumps that may engage with the inner surface of the cavity. In some instances, the inner surface of the cavity may be irregular. Friction-enhancing raised feature embodiments may be useful to provide a secure mechanical connection with irregular or non-planar surfaces. Further illustrated is cutout 126 sized to enable a tail to pass around bridge adapter 100 when installed. In embodiments, cutout 126 may be disposed along an outer surface of second side plate 102. Cutout embodiments will be discussed in further detail below for FIG. 4.

Planar body 102 may also include bottom plate 130, located proximally to first side plate 120. Bottom plate 130 may be defined by bottom plate front edge as indicated by dashed line 134 disposed along a distal end and bottom plate back edge as indicated by dashed line 144 disposed opposite the bottom plate front edge. In an embodiment, a length from the bottom plate front edge to the bottom plate back edge may be substantially the same as a length from the top plate front edge to the top plate back edge. The bottom plate front edge may be connected with the first side plate back edge by second hinge 154. Second hinge 154 may have a range of motion of more than approximately 90-degrees. In one embodiment, the range of motion is approximately 93 degrees. Second hinge 154 is preferably strong and capable of flexing without damage. In an embodiment, the second hinge is a living hinge. Bottom plate 130 preferably also includes through holes 132A and 132B. The through holes may be arranged to engage with raised features 116A and 116B when two bridge adapter embodiments are stacked on top of each other within a cavity. Stacking is further elucidated below with respect to FIG. 4.

Planar body 102 may further include second side plate 140, located proximally to bottom plate 130. Second side plate 140 may be defined by second side plate front edge as indicated by dashed line 144 disposed along a distal end and second side plate back edge as indicated by dashed line 154 disposed opposite the second side plate front edge. The length from the second side plate front edge to the second side plate back edge is preferably the same as the length from the first side plate front edge to the first side plate back edge. The second side plate front edge may be mechanically coupled with the bottom plate back edge by third hinge 156. Third hinge 156 may be different from the first and second hinges in having a wider range of motion. In embodiments, third hinge may have a range of motion of at least approximately 120 degrees. In some embodiments, third hinge may have a range of motion of at least approximately 130 degrees. This wider range of motion may enable planar body 102 to flex in such a way as to clear the walls of the cavity during insertion. The third hinge is preferably strong and capable of repeated flexing without damage. In an embodiment, the third hinge is a living hinge. Second side plate 140 may also include friction-enhancing feature 142 which may assist in retaining the bridge adapter in the cavity by engaging with the walls of the cavity. In an embodiment, as illustrated in FIGS. 1A-1C, friction-enhancing feature 142 may include two raised bumps that may engage with the rough inner surface of the cavity.

Additionally, as illustrated in FIGS. 1A-1C, bridge adapter 100 may also include tail 106 that is disposed along the second side plate back edge. Tail 106 may include a handle 108 located at the opposite end of the tail from the second side plate back edge. The handle may be curved to enable easier grasping and may include textured features to improve friction between the hand and the handle. Tail 106 is attached to the second side plate back edge by a removable connection; the removable connection is preferably a living hinge that is perforated to enable easy detachment without displacing the bridge adapter from its position in the cavity. The tail also includes a locking feature 107 that engages with the locking indent 119 when the bridge adapter is folded, locking it into a rectangular tube shape. The tail is preferably thinner than the body and is preferably stiff enough to be used to push the body into the cavity. The length of the tail is preferably sufficient to reach the bottom of the cavity without having the handle enter the cavity.

In an embodiment, one or more of the plates may include one or more support ribs 162 disposed along inner surfaces of the one or more plates. Support ribs 162 may be separately located along each plate as illustrated and may strengthen the plates in order for the bridge adapter to avoid flexing during use. In an embodiment, support ribs may extend from the front edge to the back edge of each plate and may have at least one thickness of the plate in width and thickness. Each plate may include any number of ribs.

Figure 2A:
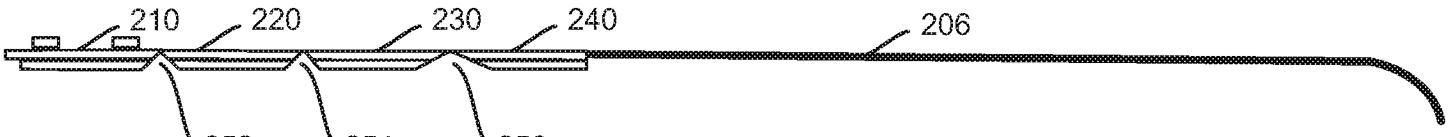
FIGS. 2A-2D are illustrative representations of a side views of a bridge adapter in accordance with embodiments of the present invention in the process of folding.
Figure 2B:
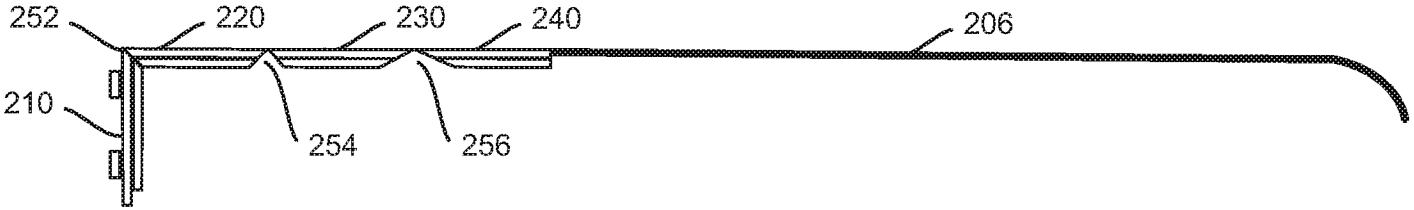
Figure 2C:
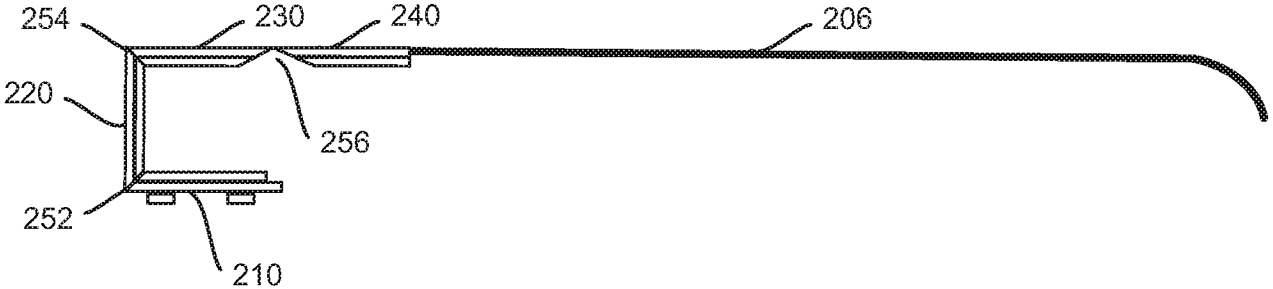
Figure 2D:
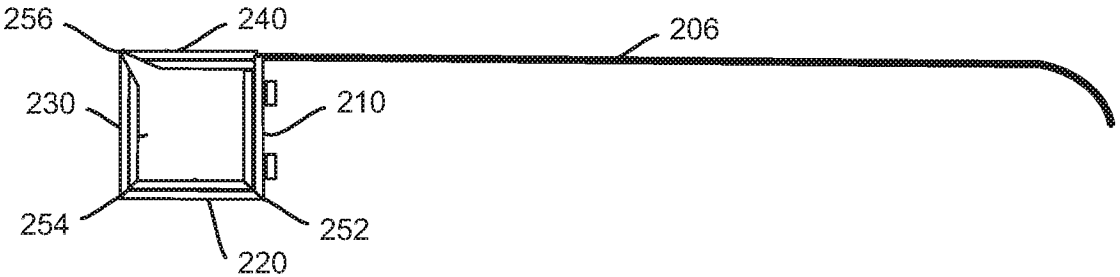

As illustrated in FIGS. 2A-2D, an embodiment of the bridge adapter may fold or bend into a rectangular tube shape. In FIG. 2A, the bridge adapter is fully unfolded and top plate 110, first side plate 120, bottom plate 130, and second side plate 140 are substantially coplanar. Tail 106 is also substantially coplanar with the four plates. The fully unfolded configuration of the bridge adapter may be used for storage or transport. FIG. 2B shows top plate 110 folded at an approximately 90-degree angle to first side plate 120. First hinge 152 is folded to produce this folded configuration. FIG. 2C shows first side plate 120 folded at an approximately 90-degree angle to bottom plate 130, with second hinge 154 being folded. Finally, FIG. 2D shows third hinge 156 folded as bottom plate 130 is folded at an approximately 90-degree angle to second side plate 140. After all the hinges are folded and the plates form roughly 90-degree angles with respect to each other, top plate 110 is locked into the second side plate 140 and the bridge adapter assumes a rectangular tube shape. The locking may happen by the locking indent 119 snapping into the locking feature 107. After the bridge adapter is locked into a rectangular tube shape, tail 106 may be detached.

Since the bridge adapter is a rectangular tube shape when folded, it will be understood that the first side plate and the second side plate are preferably the same width and that the top plate and bottom plate are preferably the same width (not necessarily the same as that of the first and second side plates). Different sizes of the bridge adapter may be available for differently sized locks and differently sized cavities. While the bridge adapter may be made of any material as long as it is sufficiently rigid to bear the weight of the bridge and the lock, in an embodiment, the bridge adapter is made of a polymeric material such as ABS, HDPE, or a similar rigid polymeric material. The first hinge, second hinge, and third hinge are preferably living hinges.

Figure 3A:
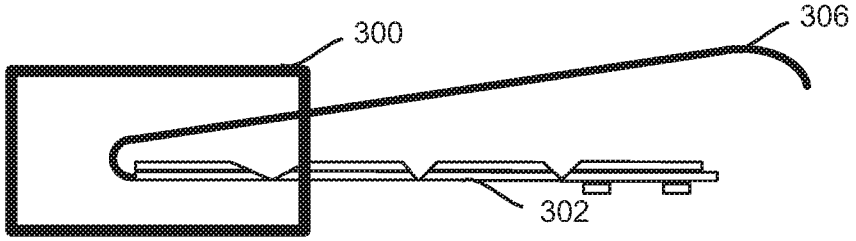
FIGS. 3A-3C are illustrative representations of cross-sectional views of a method for installing a bridge adapter in accordance with embodiments of the present invention.
Figure 3B:
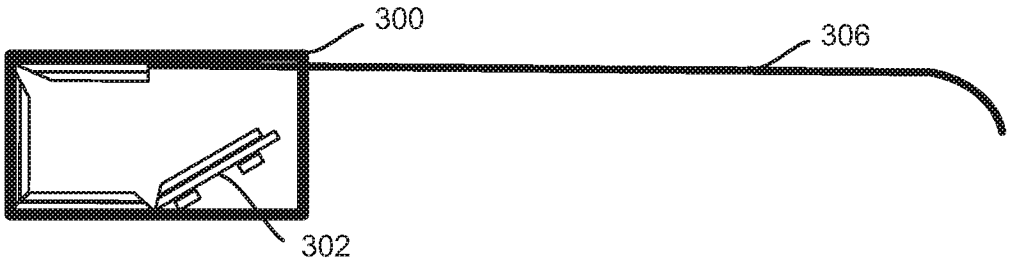
Figure 3C:
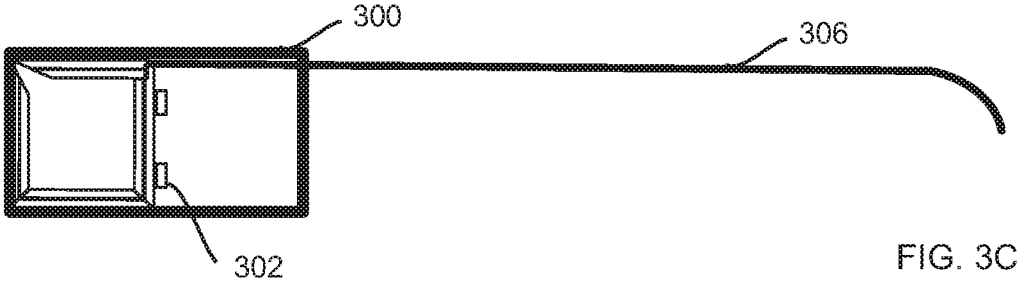

As illustrated in FIGS. 3A-3C, bridge adapter embodiments may be inserted though an opening into cavity 300 within a door stile. Tail 306 may be used to insert the bridge adapter through an opening into cavity 300, as shown in FIG. 3A. After body 302 is partially inserted into cavity 300, as shown in FIG. 3B, the second and third hinge of the bridge adapter may be bended in such a way that the first side plate comes in contact with a wall of the cavity; the bottom plate comes in contact with the bottom of the cavity; and the second side plate comes in contact with another wall of the cavity as shown. In embodiments, the first hinge and the second hinge have a range of motion of more than approximately 90-degrees. In an embodiment, the third hinge has a range of motion of at least approximately 120 degrees to enable the bottom plate front edge and first side plate back edge to clear the wall of the cavity as the bridge adapter folds into position. In some embodiments, the third hinge has a range of motion at least approximately 130 degrees.

As illustrated in FIG. 3C, the top plate of bridge adapter 302 is placed into position. In an embodiment, sufficient pressure may be applied to the top plate to engage the locking indent with the raised locking feature. In an embodiment, the tail may be detached after the bridge adapter is installed. The tail may be useful in positioning bridge adapter embodiments after the locking indent engages with the raised locking feature. The tail may be detached by any method known in the art such as by cutting or by tearing along a perforation.

Figure 4A:
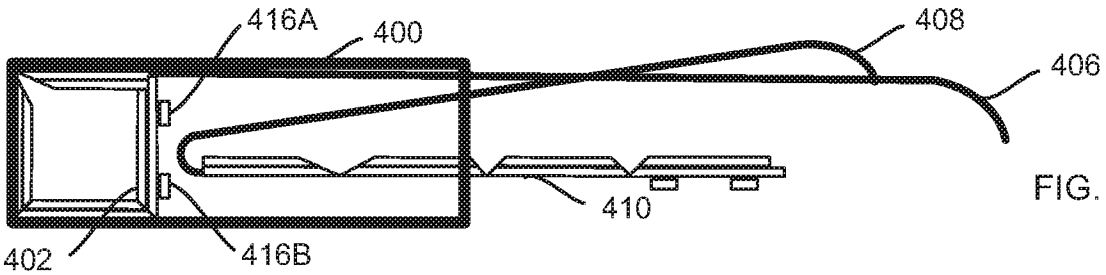
FIGS. 4A-4C are illustrative representation representations of cross-sectional views of methods for installing two bridge adapters in accordance with embodiments of the present invention.
Figure 4B:
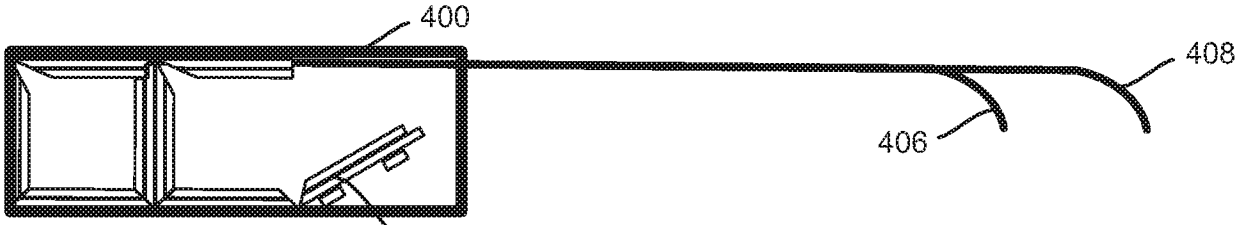
Figure 4C:
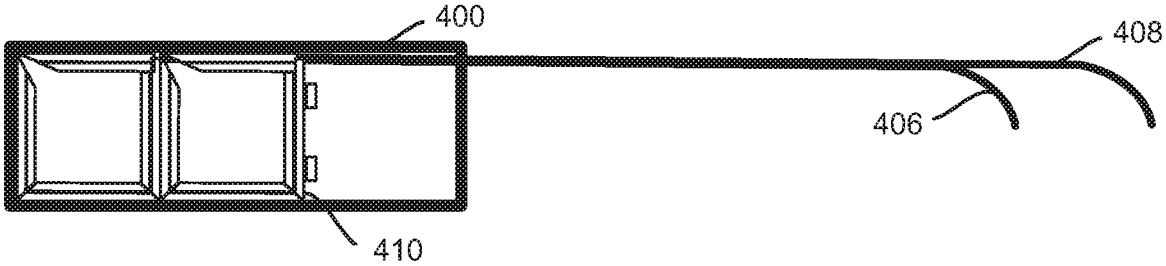

It may be appreciated that in some examples, a cavity may be encountered that is deeper than one bridge adapter can accommodate. In such examples, a second bridge adapter may be needed. In an embodiment, a second bridge adapter may be installed on top of a first bridge adapter, as shown in FIGS. 4A-4C. As illustrated in FIG. 4A, a second bridge adapter may be inserted into cavity 400 into which a first bridge adapter is already installed. It may be noted that the tail of the first bridge adapter is not detached but passes along a cutout. In embodiments, both tails are detached only after both bridge adapters are installed. As noted above, tails may be useful in positioning bridge adapters after locking. In other embodiments, the tail of the first bridge adapter may be detached before the second bridge adapter is installed.

As shown in FIG. 4B, the second bridge adapter may be installed in a manner similar to the first bridge adapter as shown in FIG. 3B. Similarly to FIG. 3B, the second and third hinge of the bridge adapter may be hinged in such a way that the first side plate comes in contact with a wall of the cavity; the bottom plate comes in contact with the bottom of the cavity; and the second side plate comes in contact with another wall of the cavity as shown. In embodiments, the first hinge and the second hinge have a range of motion of more than approximately 90-degrees. In an embodiment, the third hinge has a range of motion of at least approximately 120 degrees to enable the bottom plate front edge and first side plate back edge to clear the wall of the cavity as the bridge adapter folds into position. In some embodiments, the third hinge has a range of motion of at least approximately 130 degrees. Raised features 416A and 416B of the top plate of first bridge adapter 402 may engage the through holes (see FIG. 1, 132A and 132B) of the bottom plate of second bridge adapter 410, locking the second bridge adapter into place.

FIG. 4C illustrates the next stage of the installation of second bridge adapter 410. As illustrated, after the bottom plate of the second bridge adapter is in contact with the top plate of the first bridge adapter and the first and second side plates of the second bridge adapter are in contact with the walls of the cavity, the first hinge is folded or bent to an approximately 90-degree angle by applying pressure to the top plate of the second bridge adapter. The pressure may be applied until the locking indent engages with the raised locking feature and the second bridge adapter is locked in place. In an embodiment, the tails of both bridge adapters may be detached after installation. The tail may be useful in positioning bridge adapter embodiments after the locking indent engages with the raised locking feature. The tail may be detached by any method known in the art such as by cutting or by tearing along a perforation. In an embodiment, one or both of the side plates includes a cutout of an approximate size and shape to accommodate the passage of a tail disposed along an outer surface of bridge adapter 400 (see FIG. 1A, 126). This enables the second bridge adapter to be installed on top of a first bridge adapter without detaching the tail of the first bridge adapter.

Figure 6:
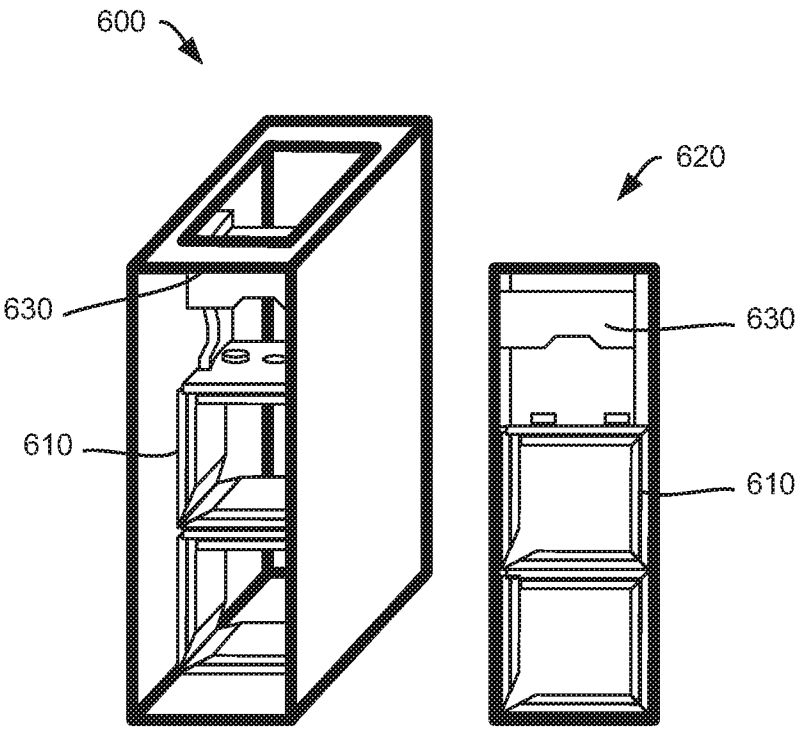
FIG. 6 is an illustrative representation of two installed bridge adapters and bridge in accordance with embodiments of the present invention.
Figure 5:
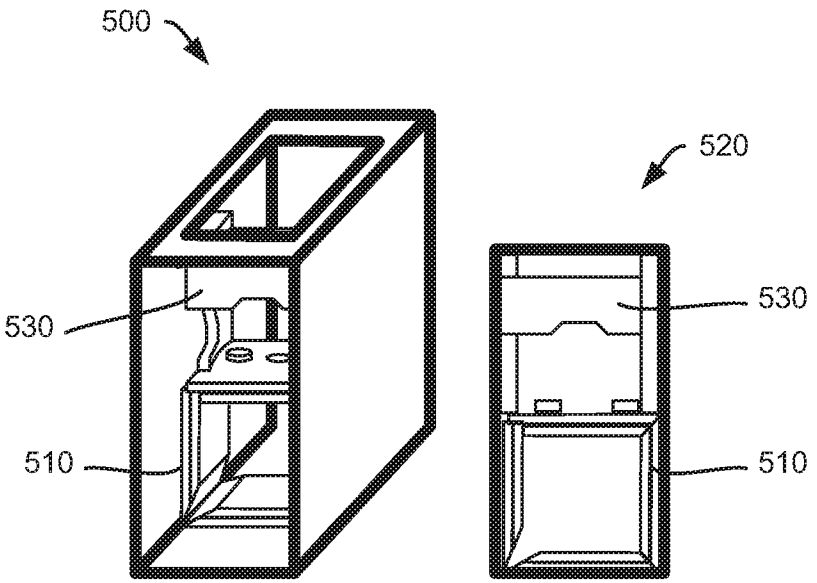
FIG. 5 is an illustrative representation an installed bridge adapter and bridge in accordance with embodiments.

FIGS. 5 and 6 installed bridge adapter embodiments and bridges in accordance with embodiments of the present invention. As utilized herein, a bridge is a structure which can support a mortise lock or faceplate. FIG. 5 illustrates bridge adapter 510 installed in door stile 500. Bridge 530 may be coupled with bridge adapter 510 as shown. In embodiments, a mortise lock or faceplate may then be coupled with and supported by bridge 530. In some examples, a door stile may require an additional bridge adapter. Thus, as illustrated in FIG. 6, bridge adapter 610 may be installed in door stile 600. Bridge 630 may be coupled with bridge adapter 610 as shown. In embodiments, a mortise lock or faceplate may then be coupled with and supported by bridge 630

As can be seen in FIGS. 5 and 6, the tails of the bridge adapters may be removed after installation. In an embodiment, the tail is connected with the body using a perforated living hinge that may be detached without special tools. In alternate embodiments, the tail may be made of a separate piece of material and attached to the body using adhesives or a fastener.

ALTERNATE EMBODIMENTS

FIGS. 7A-7C are illustrative representations of various views of a bridge adapter in accordance with embodiments of the present invention. In particular, as illustrated in FIGS. 7A to 7C, bridge adapter 700 may include planar body 702 which may further include a number of features. For example, as illustrated, planar body 702 includes first plate 710, located proximally to second plate 720. First plate 710 may be defined by first plate front edge as indicated by dashed line 714 disposed along a proximal end and by first plate back edge as indicated by dashed line 724 disposed opposite the first plate front edge. The length from the first plate front edge to the first plate back edge is preferably the same as the length from the second plate front edge to the second plate back edge. The first plate front edge may be mechanically coupled with the second plate back edge by leading hinge 756. Leading hinge 756 may be different from the first and middle hinges in having a wider range of motion. In embodiments, leading hinge may have a range of motion of at least approximately 120 degrees. In some embodiments, leading hinge may have a range of motion of at least approximately 130 degrees. This wider range of motion may enable planar body 702 to flex in such a way as to clear the walls of a door stile cavity during insertion. The leading hinge is preferably strong and capable of repeated flexing without damage. In an embodiment, the leading hinge is a living hinge. Additionally, as illustrated, bridge adapter 700 also includes locking feature 707 that engages with the locking indent 719 when the bridge adapter is folded, locking it into a rectangular tube shape.

Planar body 702 may also include second plate 720, located proximally to second plate 720. Second plate 720 may be defined by second plate front edge as indicated by dashed line 724 disposed along a proximal end and by second plate back edge as indicated by dashed line 734 disposed opposite the second plate front edge. In an embodiment, a length from the second plate front edge to the second plate back edge may be substantially the same as a length from the first plate front edge to the first plate back edge. The second plate front edge may be mechanically coupled with the second plate back edge by middle hinge 754. Middle hinge 754 may have a range of motion of more than approximately 90-degrees. In one embodiment, the range of motion is approximately 93 degrees. Middle hinge 754 is preferably strong and capable of flexing without damage. In an embodiment, the middle hinge is a living hinge. Second plate 720 preferably also includes through holes 732A and 732B. The through holes may be arranged to engage with raised features 716A and 716B when two bridge adapter embodiments are stacked on top of each other within a door stile cavity. Stacking is further elucidated below with respect to FIG. 10.

Planar body 702 may additionally include third plate 730, located proximally to first plate 710. Third plate 730 may be defined by third plate front edge as indicated by dashed line 734 disposed along a proximal end and by third plate back edge as indicated by dashed line 744 disposed opposite the third plate front edge. The third plate front edge may be mechanically coupled with the fourth plate back edge by trailing hinge 752. In embodiments, trailing hinge 752 may have a range of motion of more than approximately 90 degrees. In one embodiment, a range of motion of the trailing hinge is approximately 93 degrees. Trailing hinge 752 is preferably strong and capable of flexing without damage. In one embodiment, the trailing hinge is a living hinge. As known in the art, a living hinge is a thin flexible hinge (flexure bearing) made from the same material as the two rigid pieces it connects, rather than cloth, leather, or some other flexible substance. A living hinge is typically thinned, cut, or formed to allow the rigid pieces to bend along the line of the hinge. Third plate 730 may also include friction-enhancing features 722 which may assist in retaining the bridge adapter in a door stile cavity by engaging with the walls of the door stile cavity. In an embodiment, as illustrated in FIG. 7A, friction-enhancing feature 722 includes two raised bumps that may engage with the inner surface of the door stile cavity. In some instances, the inner surface of the door stile cavity may be irregular. Friction-enhancing raised feature embodiments may be useful to provide a secure mechanical connection with irregular or non-planar surfaces. Further illustrated is indent 726 sized to enable a tool or wire to pass around bridge adapter 700 when installed.

Planar body 702 may additionally include fourth plate 740, that is disposed along proximal edge of planar body 702. Fourth plate 740 may be defined by fourth plate front edge as indicated by dashed line 744 disposed along a proximal end and by fourth plate back edge as indicated by dashed line 754 disposed opposite fourth plate front edge. The illustrated dashed lines are for clarity in defining the various plates presented across all views. Further illustrated are raised features 716A and 716B. Raised features 716A and 716B may be useful in stacking bridge adapter embodiments as will be discussed in further detail below for FIG. 10. In addition, fourth plate 740 may include a through hole 718, which may be smooth bore or threaded and centered with the fourth plate in embodiments. Still further illustrated is locking indent 719 sized to couple with locking tab 707.

In an embodiment, one or more of the plates may include one or more support ribs 762A, 762B, 764, 766A, 766B, and 768 disposed along inner surfaces of the one or more plates. Support ribs 764, 766A, 766B are low profile. Support ribs 762A and 762B have a higher profile and are configured to align plates during installation. In addition, support ribs 762A and 762B improve closure of the bridge adapter during installation. Support rib 768 includes a ring structure (see for example, FIG. 7B side view). The ring structure may be used to temporarily secure a wire or cable during installation. It may be useful to attach a wire or cable to manipulate and place bridge adapters where space is limited. It may also be useful to attach a wire or cable to retain the bridge adapter during installation so that the bridge adapter is not dropped inside a door stile cavity. Support ribs may be separately located along each plate as illustrated and may strengthen the plates in order for the bridge adapter to avoid flexing during use. In an embodiment, support ribs may extend from the front edge to the back edge of each plate and may have at least one thickness of the plate in width and thickness. Each plate may include any number of ribs.

Figure 8A:
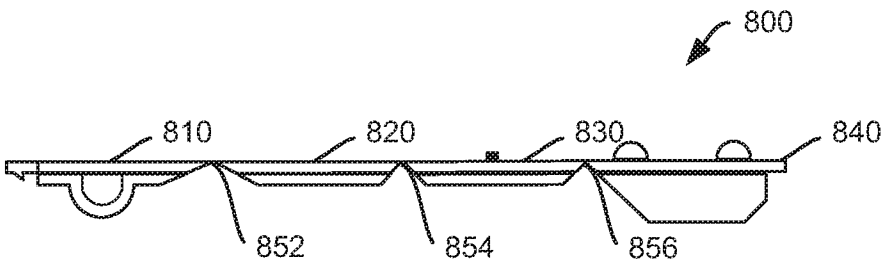
FIGS. 8A-8D are illustrative representations of a side views of a bridge adapter in accordance with embodiments of the present invention in the process of folding.
Figure 8B:
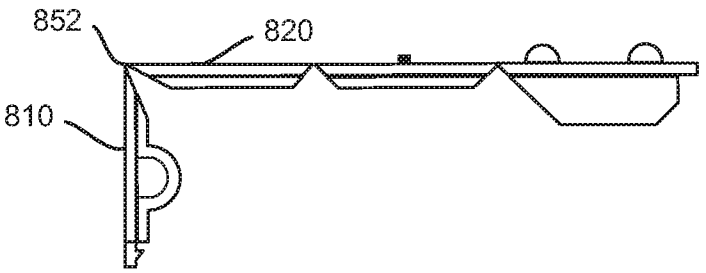
Figure 8C:
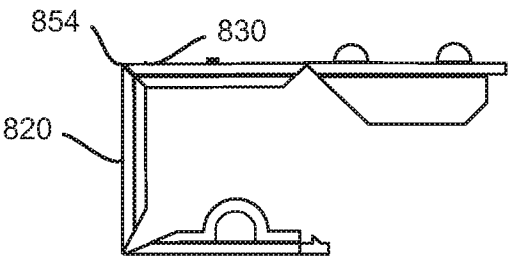
Figure 8D:
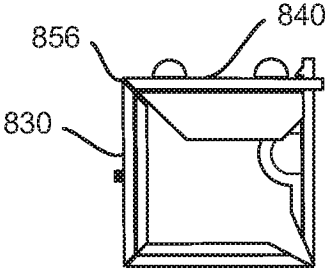

FIGS. 8A-8D are illustrative representations of a side views of a bridge adapter in accordance with embodiments of the present invention in the process of folding. As illustrated in FIGS. 8A-8D, an embodiment of the bridge adapter may fold or bend into a rectangular tube shape. In FIG. 8A, the bridge adapter is fully unfolded and plate 810, plate 820, plate 830, and plate 840 are substantially coplanar. The fully unfolded configuration of the bridge adapter may be used for storage or transport. FIG. 8B shows plate 810 folded at an approximately 90-degree angle to plate 820. Leading hinge 852 is folded to produce this folded configuration. FIG. 8C shows plate 820 folded at an approximately 90-degree angle to plate 830, with middle hinge 854 being folded. Finally, FIG. 8D shows trailing hinge 856 folded as plate 830 is folded at an approximately 90-degree angle to plate 840. After all the hinges are folded and the plates form approximately 90-degree angles with respect to each other, plate 810 is secured with plate 840 and the bridge adapter assumes a rectangular tube shape. The locking may occur by locking indent 719 coupling with locking feature 707 (see FIGS. 7A-7C).

Since the bridge adapter is a rectangular tube shape when folded, it will be understood that the second plate and the fourth plate are preferably the same width and that the first plate and third plate are preferably the same width (not necessarily the same as that of the first and fourth plates). Different sizes of the bridge adapter may be available for differently sized locks and differently sized door stile cavities. While the bridge adapter may be made of any material as long as it is sufficiently rigid to bear the weight of the bridge and the lock, in an embodiment, the bridge adapter is made of a polymeric material such as ABS, HDPE, polyurethane, or a similar semi-rigid polymeric material. The trailing hinge, middle hinge, and leading hinge are preferably living hinges.

Figure 9A:
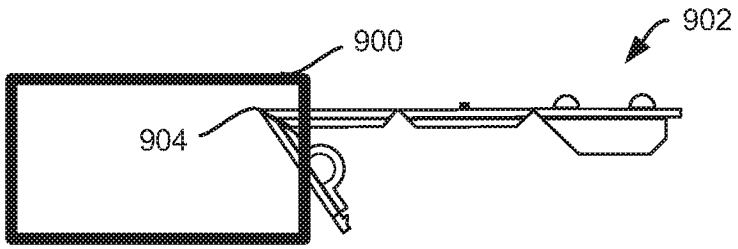
FIGS. 9A-9C are illustrative representations of cross-sectional views of a method for installing a bridge adapter in accordance with embodiments of the present invention.
Figure 9B:
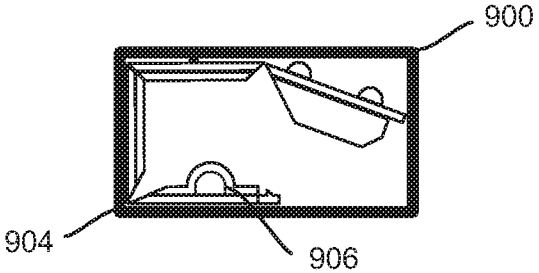
Figure 9C:
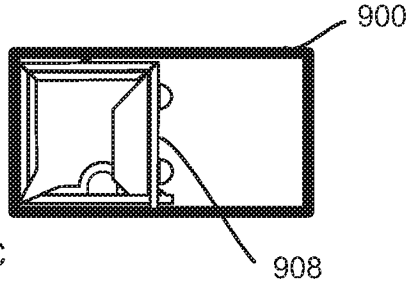

FIGS. 9A-9C are illustrative representations of cross-sectional views of a method for installing a bridge adapter in accordance with embodiments of the present invention. As illustrated in FIGS. 9A-9C, bridge adapter 902 may be inserted through an opening into door stile cavity 900. In FIG. 9A leading hinge 904 may be folded to greater than 90-degrees to accommodate an opening smaller than the width of the door stile cavity. After bridge adapter 902 is partially inserted into door stile cavity 900, as shown in FIG. 9B, leading hinge 904 may be folded in such a way that one plate comes in contact with a side-wall (long side) of the door stile cavity; another plate comes in contact with the back-wall (short side) of the door stile cavity; and still another plate comes in contact with a side-wall of the door stile cavity as shown. The terms "side-wall" and "back-wall" are for use in clarifying the illustrative representations and should not be construed as limiting. It may be appreciated that ring structure 906 may be optionally utilized to temporarily attach a wire, cable, or other positioning device to "pull" the bridge adapter into place. In embodiments, the middle hinge and the trailing hinge have a range of motion of more than approximately 90-degrees. In an embodiment, the leading hinge has a range of motion of at least approximately 120 degrees to enable the corresponding plate edges to clear the wall of the door stile cavity as the bridge adapter folds into position. In some embodiments, the leading hinge has a range of motion at least approximately 130 degrees to accommodate even smaller openings.

As illustrated in FIG. 9C, plate 908 is hinged into closed position. In an embodiment, sufficient pressure may be applied to the plate to engage the locking indent with the locking tab (see FIGS. 7A-7C).

Figure 10A:
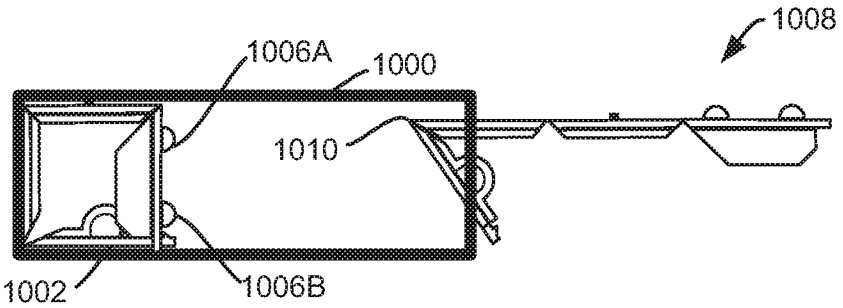
FIGS. 10A-10C are illustrative representation representations of cross-sectional views of methods for installing two bridge adapters in accordance with embodiments of the present invention.
Figure 10B:
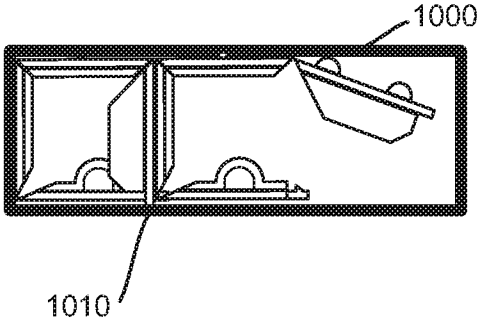
Figure 10C:
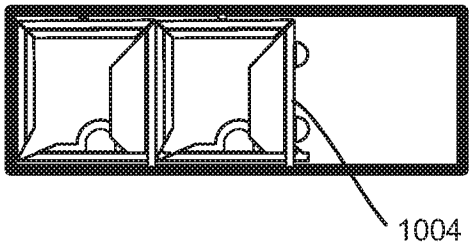

It may be appreciated that in some examples, a door stile cavity may be encountered that is deeper than one bridge adapter can accommodate. In such examples, a second bridge adapter may be needed. In an embodiment, a second bridge adapter may be installed on top of a first bridge adapter, as shown in FIGS. 10A-10C. As illustrated in FIG. 10A, bridge adapter 1008 may be inserted into door stile cavity 1000 in which bridge adapter 1002 is already installed. As illustrated, leading hinge 1010 may be folded to greater than 90-degrees to accommodate an opening smaller than the width of the door stile cavity.

After bridge adapter 1008 is partially inserted into door stile cavity 1000, as shown in FIG. 10B, leading hinge 1010 may be folded in such a way that one plate comes in contact with a side-wall (long side) of the door stile cavity; another plate comes in contact with the surface of bridge adapter 1002; and still another plate comes in contact with a side-wall of the door stile cavity as shown. Raised features 1006A and 1006B of bridge adapter 1002 may engage the through holes (see FIG. 7, 732A and 732B) of bridge adapter 1010, thus locking the bridge adapter into place. The terms "side-wall" and "back-wall" are for use in clarifying the illustrative representations and should not be construed as limiting. It may be appreciated that ring structure 906 may be optionally utilized to temporarily attach a wire, cable, or other positioning device to "pull" the bridge adapter into place. In embodiments, the middle hinge and the trailing hinge have a range of motion of more than approximately 90-degrees. In an embodiment, the leading hinge has a range of motion of at least approximately 120 degrees to enable the corresponding plate edges to clear the wall of the door stile cavity as the bridge adapter folds into position. In some embodiments, the leading hinge has a range of motion at least approximately 130 degrees to accommodate even smaller openings.

As illustrated in FIG. 10C, plate 1004 is hinged into closed position. In an embodiment, sufficient pressure may be applied to the plate to engage the locking indent with the locking tab (see FIGS. 7A-7C).

The terms "certain embodiments", "an embodiment", "embodiment", "embodiments", "the embodiment", "the embodiments", "one or more embodiments", "some embodiments", and "one embodiment" mean one or more (but not all) embodiments unless expressly specified otherwise. The terms "including", "comprising", "having" and variations thereof mean "including but not limited to", unless expressly specified otherwise. The enumerated listing of items does not imply that any or all of the items are mutually exclusive, unless expressly specified otherwise. The terms "a", "an" and "the" mean "one or more", unless expressly specified otherwise.

While this invention has been described in terms of several embodiments, there are alterations, permutations, and equivalents, which fall within the scope of this invention. It should also be noted that there are many alternative ways of implementing the methods and apparatuses of the present invention. Furthermore, unless explicitly stated, any method embodiments described herein are not constrained to a particular order or sequence. Further, the Abstract is provided herein for convenience and should not be employed to construe or limit the overall invention, which is expressed in the claims. It is therefore intended that the following appended claims be interpreted as including all such alterations, permutations, and equivalents as fall within the true spirit and scope of the present invention.

What is claimed is:

1. A bridge adapter configured for insertion into a door stile cavity within a door stile, the bridge adapter comprising:

a planar body including, a first plate disposed along a proximal end of the planar body, wherein the first plate includes a first plate front edge disposed along the proximal end and a first plate back edge located along opposite ends of the first plate, wherein the first plate front edge includes a locking tab sized to couple with a locking indent, a second plate including a second plate front edge and a second plate back edge located along opposite ends of the second plate, wherein the second plate front edge is mechanically coupled along the first plate back edge by a leading hinge, wherein the second plate includes at least one through hole sized to receive the at least one raised feature, a third plate including a third plate front edge and a third plate back edge located along opposite ends of the third plate, wherein the third plate is mechanically coupled along the third plate front edge and the second plate back edge by a middle hinge, and a fourth plate including a fourth plate front edge and a fourth plate back edge located along opposite ends of the fourth plate, wherein the fourth plate front edge is mechanically coupled along the third plate back edge by a trailing hinge.

2. The bridge adapter of claim 1, wherein the planar body is manufactured from a polymeric material and wherein the leading hinge, the middle hinge, and the trailing hinge are living hinges.

3. The bridge adapter of claim 1, wherein at least one of the first plate, the second plate, the third plate, and the fourth plate comprises at least one support rib disposed along an inner surface of the plate.

4. The bridge adapter of claim 1, wherein all of the plates comprise at least one support rib disposed along an inner surface of each plate.

5. The bridge adapter of claim 4, wherein the first plate comprises a rib having a ring structure positioned along the rib.

6. The bridge adapter of claim 4, wherein the fourth plate comprises a rib having a raised profile configured to align the plates during an installation.

7. The bridge adapter of claim 5 further comprising a wire temporarily coupled with the ring structure during an installation.

8. The bridge adapter of claim 1, wherein the middle hinge and trailing hinge have a range of motion of more than approximately 90-degrees and wherein the leading hinge has a range of motion of at least approximately 120 degrees.

9. The bridge adapter of claim 8, wherein the leading hinge has a range of motion of at least approximately 130 degrees.

10. The bridge adapter of claim 1, wherein the second plate is substantially the same width as the door stile cavity, wherein the third side plate comprises a friction-enhancing feature for engaging a wall of the door stile cavity, and wherein the friction enhancing feature is raised and disposed along an outer surface of the third plate.

11. The bridge adapter of claim 1, wherein the third side plate comprises an indent sized to enable a wire or flat cable to pass around the bridge adapter, and wherein the indent is disposed along an outer surface of the third plate.

12. The bridge adapter of claim 1, wherein the fourth plate further comprises a through hole centered with the fourth plate.

13. A method of installing bridge adapters in a door stile cavity comprising:

providing a first bridge adapter, wherein the first bridge adapter comprises:

a planar body including, a first plate disposed along a proximal end of the planar body, wherein the first plate includes a first plate front edge disposed along the proximal end and a first plate back edge located along opposite ends of the first plate, wherein the first plate front edge includes a locking tab sized to couple with a locking indent, a second plate including a second plate front edge and a second plate back edge located along opposite ends of the second plate, wherein the second plate front edge is mechanically coupled along the first plate back edge by a leading hinge, wherein the second plate includes at least one through hole sized to receive the at least one raised feature, a third plate including a third plate front edge and a third plate back edge located along opposite ends of the third plate, wherein the third plate is mechanically coupled along the third plate front edge and the second plate back edge by a middle hinge, and a fourth plate including a fourth plate front edge and a fourth plate back edge located along opposite ends of the fourth plate, wherein the fourth plate front edge is mechanically coupled along the third plate back edge by a trailing hinge;

inserting the first bridge adapter into the door stile cavity through the opening by folding the leading hinge at least more than 90 degrees;

folding the leading hinge and the middle hinge of the first bridge adapter in such a way that the first plate is in contact with a first wall of the door stile cavity, the second plate is in contact with a back wall of the door stile cavity, and the third plate is in contact with a second wall of the door stile cavity; and folding the tailing hinge of the first bridge adapter such that the locking indent engages with the locking tab.

14. The method of claim 13, further comprising:

providing a second bridge adapter;

inserting a second bridge adapter into the door stile cavity;

inserting the second bridge adapter into the door stile cavity through the opening;

folding a leading hinge and a middle hinge of the second bridge adapter in such a way that a first plate of the second bridge adapter is in contact with the first wall of the door stile cavity, a second plate of the second bridge adapter is in contact with the back wall of the door stile cavity, and a third plate of the second bridge adapter is in contact with the second wall of the door stile cavity;

engaging the at least one raised feature of the first bridge adapter with the at least one through hole of the second bridge adapter; and folding a trailing hinge of the second bridge adapter such that a locking indent of the second bridge adapter engages with a locking tab of the second bridge adapter.

15. The method of claim 13, wherein the middle hinge and the trailing hinge have a range of more than approximately 90-degrees and wherein the leading hinge has a range of at least approximately 120 degrees.

16. The method of claim 13, wherein the leading hinge has a range of motion of at least approximately 130 degrees.

* * * * *